United States Patent [19]

Bachmann

[11] 4,434,752

[45] Mar. 6, 1984

[54] INTERNAL COMBUSTION ENGINE

[76] Inventor: William V. Bachmann, 22517 Ten Mile Rd., St. Clair Shores, Mich. 48080

[21] Appl. No.: 280,340

[22] Filed: Jul. 6, 1981

[51] Int. Cl.[3] ..... F02B 75/18

[52] U.S. Cl. ..... 123/50 B; 123/52 B

[58] Field of Search ..... 123/193 R, 193 P, 193 CP, 123/52 R, 52 B, 51 R, 51 A, 50

[56] References Cited

U.S. PATENT DOCUMENTS

| | | | |
|---|---|---|---|
| 1,189,872 | 7/1916 | Rogers | 123/50 R |
| 1,514,475 | 11/1924 | Still | 123/52 B |
| 1,734,867 | 11/1929 | Martin | 123/50 R |
| 2,734,494 | 2/1956 | Waterval | 123/52 B |

*Primary Examiner*—Craig R. Feinberg

*Attorney, Agent, or Firm*—Lon H. Romanski

[57] ABSTRACT

An engine is shown as having a ring-like cylinder with a ring type piston reciprocatingly received therein, connecting rods operatively interconnect the ring piston to a related crankshaft; the combustion chamber means is formed generally by two chamber volumes the first of which is defined by the annular space between the working surface of the ring piston and the juxtaposed cylinder head surface and the second of which is defined by a generally medially or centrally formed chamber of unexpandable volume; the two chamber volumes communicate with each other as by a relatively narrow opening formed generally peripherally about the chamber of unexpandable volume.

75 Claims, 11 Drawing Figures

INTERNAL COMBUSTION ENGINE

FIELD OF INVENTION

This invention relates generally to internal combustion engines and more particularly to internal combustion engines of the type employing an annular or ring-type piston reciprocatingly received within a cooperating annular or ring-type cylinder.

BACKGROUND OF THE INVENTION

Heretofore, various forms of ring-type piston engines have been proposed by the prior art. It has been found that such prior art engines are susceptible to experiencing problems arising out of and during, generally, ignition of the motive fluid or combustible mixture within the piston cylinder combustion chamber.

For example, in such an annular or ring-shaped combustion chamber, if ignition of the combustible mixture therein is initiated at a single point, then, before combustion is completed, flame propagation must occur in a generally circular path (within the ring-shaped combustion chamber) until such flame reaches (theoretically) a point diametrically opposite the point where ignition was initiated. As a consequence of such an annular path (in both directions about the centerline or axis of the ring-shaped combustion chamber) of flame propagation, a higher combustion chamber pressure can be produced at the point of initiation of ignition than at the point diametrically opposite to the point of ignition initiation. As a result of such differing magnitudes of pressure, the ring piston (within the ring-like cylinder) would tend to tilt generally toward the higher pressure area thereby causing additional stresses and uneven wear of, for example, the ring or annular piston and ring-like cylinder.

The prior art has heretofore suggested the employment of a plurality of igniters situated as to be equally spaced about the ring-like cylinder and combustion chamber thereby, when simultaneously fired resulting in a much-more equalized pressure and eliminating the undesirable pressure difference as hereinbefore described with reference to the employment of a single igniter. The use of such a plurality of igniters to cause simultaneous ignition at a corresponding plurality of points is, generally, an acceptable arrangement; however, such an arrangement still is susceptible to the creation of the previously described undesirable pressure differences. That is, if in such a multi-igniter system one or more of the igniters for some reason fails to fire and, at that location, initiate ignition of the combustible mixture, then, it should be apparent, the previously described undesirable pressure differences will occur.

Accordingly, the invention as herein disclosed and described is directed, primarily, to the aforementioned as well as other related and/or attendant problems of the prior art.

SUMMARY OF THE INVENTION

According to one aspect of the invention, an internal combustion engine comprises an engine housing, an annular cylinder formed in said housing, said annular cylinder comprising a first radially inner annular wall and a second radially outer annular wall, a ring-like piston received in said annular cylinder for reciprocating movement therein, motion transmitting means operatively connected to said ring-like piston for transmitting the reciprocating movement of said ring-like piston to associated power output means, and combustion chamber means, said combustion chamber means comprising a first ring-like combustion chamber portion defined generally and cooperatively by said inner and outer annular walls and said piston, said combustion chamber means further comprising a second combustion chamber portion situated generally axially of said first ring-like combustion chamber portion, said first and second combustion chamber portions being in communication with each other, and said second combustion chamber portion being of unexpandable volume.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Referring now in greater detail to the drawings, FIGS. 1, 2, 3 and 4 illustrate, in somewhat simplified form, an engine 10 employing teachings of the invention. As generally depicted, engine 10 is shown as comprising engine housing means 12 which, in turn, preferably comprises housing sections or portions 14, 16, 17 and 18 suitably fixedly secured to and/or through each other as by any suitable securing means.

Figure 1:
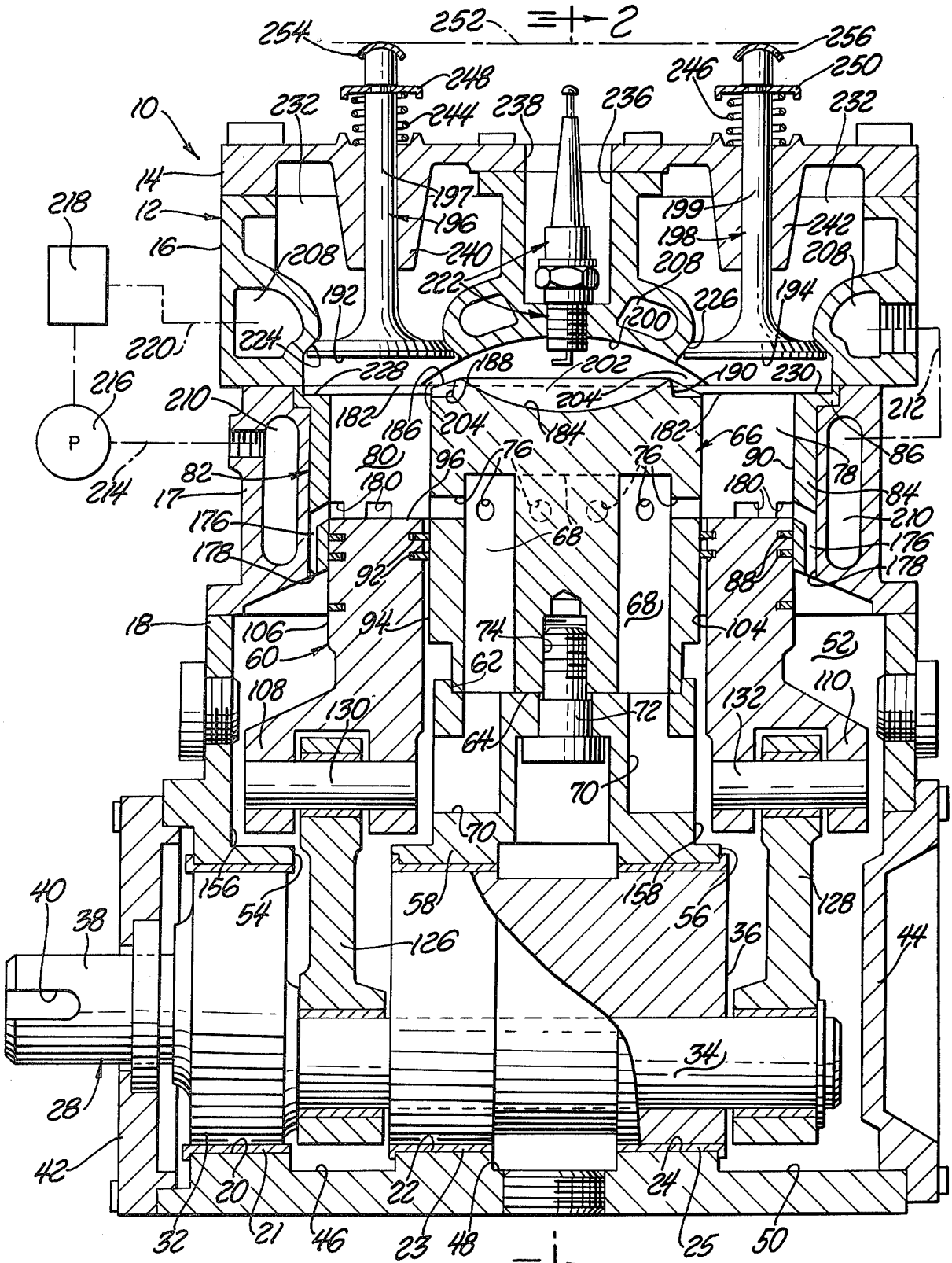
FIG. 1 is a generally elevational cross-sectional view of an engine embodying teachings of the invention.

The lower disposed engine housing section 18 may also serve as the engine crankshaft housing and, as such, is provided with bores 20, 22 and 24 respectively receiving therein, preferably by press-fit, sleeve bearings or journals 21, 23 and 25 which serve to rotatingly support crankshaft means 28. As depicted in FIG. 1, crankshaft means 28 is preferably comprised as of a first journal portion 32, rotatably supported in bearing or journal 21, and an integrally formed eccentric or throw shaft portion 34 which, in turn, is rotatably received through an eccentrically disposed passageway formed in an intermediate rotatable journal member 36 received within bearing or journal members 23 and 25. An output shaft portion 38 of crank means 28 may be provided as with suitable key slot means 40, or the like, in order to thereby be able to drive some related power consuming means. The lower housing portion 18 may be provided with end-type closure members 42 and 44 for providing, when needed, access to the crankshaft means 28 and related components. It is contemplated that the live bearing means 36 may be partly hollow in order to thereby, for example, improve the dynamic balance thereof. Even though not necessary to the practice of the invention, in the preferred form thereof, relieved openings or clearances 46, 48 and 50 are provided and such may be of generally annular configuration as typically illustrated at 48 of FIG. 2 and wherein clearances 46 and 50 communicate with and generally comprise a portion of an overall charge or pre-induction chamber 52 as by means of respective openings or passages 54 and 56.

Depicted generally centrally of crank housing section 18, a generally upwardly extending portion 58 is provided with such having, for example, an effective outer diameter significantly smaller than the inner diameter of the related annular or ring piston 60. The upper end of riser portion 58 is preferably provided as with an annular counterbore 62 effective for receiving therein, as in a mating manner, the lower end 64 of related inner ring-cylinder core or body means 66 which, when assembled as depicted, results in an annular or ring-like chamber-like passage portion or means 68. A plurality of generally radially and vertically extending passage or conduit means 70 serve to complete communication as between such pre-induction or charge chamber means 52 and passage means 68 of core means 66.

The ring-cylinder core means 66 may be secured to riser 58 as by, for example, suitable bolt means 72 threadably engaged as in a tapped hole 74 of ring-cylinder core or inner body means 66. Further, the ring-cylinder core 66 is provided with a plurality of ports or passages 76 which are generally equally spaced and radially directed as to complete timed communication as between passage 68 and the combustion chamber of the annular or ring-like cylinder 78 reciprocatingly containing ring piston means 60. The ports or passages 76 are so located or of such a configuration as to become sufficiently uncovered and thereby provide sufficient communication as between the passage or chamber means 68 and the combustion chamber portion 80, of the ring cylinder 78, when the piston means 60 reaches its bottom-dead-center (B.D.C.) operating position. As will hereinafter become even more apparent, when the piston means 60 moves to its B.D.C., the air supply or air-fuel mixture somewhat precompressed in the chamber or space 52, existing, effectively, below the piston means 60, is permitted to flow through passage or conduit means 70, into passage or chamber means 68 and through ports or conduits 76 into the combustion chamber portion 80 of annular or ring cylinder 78.

Figure 2:
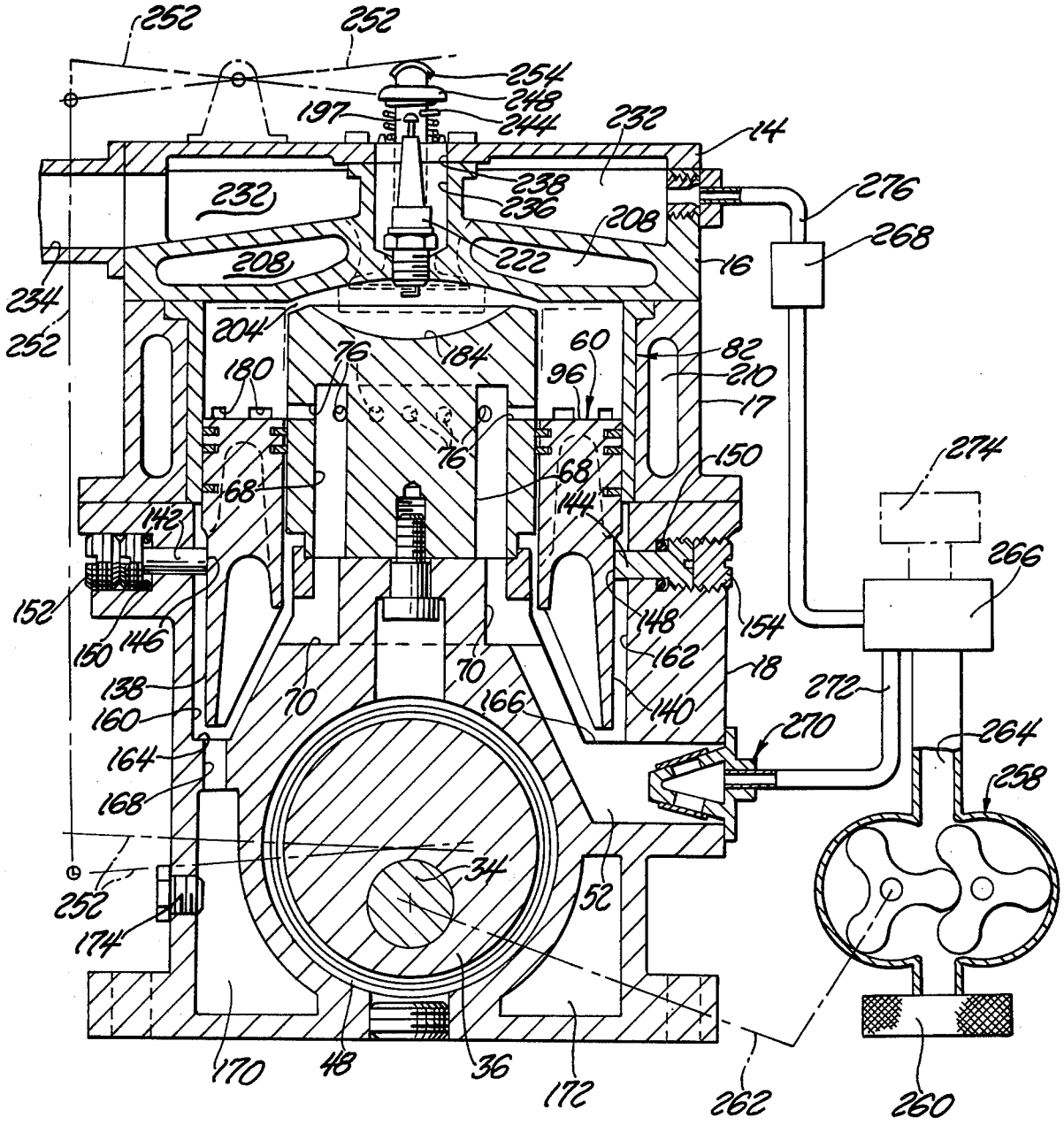
FIG. 2 is a cross-sectional view, in comparatively reduced scale, taken generally on the plane of line 2—2 of FIG. 1 and looking in the direction of the arrows.

Referring in particular to FIGS. 1 and 2, a generally tubular sleeve or liner 82, preferably comprised of material which is harder than that of engine housing section 17, having a cylindrical wall 84 and radiating flange 86, is operatively carried by and internally of housing section 17. A plurality outer piston rings 88, carried by the piston means 60, are each resiliently urged radially outwardly as to be in sliding contact with the inner cylindrical surface 90 of liner or sleeve 82. A second plurality of inner piston rings 92, carried by the piston means 60, are each resiliently urged radially inwardly as to be in sliding contact with the outer cylindrical surface 94 of core body member or means 66. As should be apparent, the outer cylindrical surface 94 of inner ring-cylinder core 66, the inner cylindrical wall or surface 90 of sleeve 82, the top surface 96 of piston means 60 and the annular juxtaposed undersurface of engine housing section 16 cooperate to define the annular cylinder combustion chamber 80.

Figure 5:
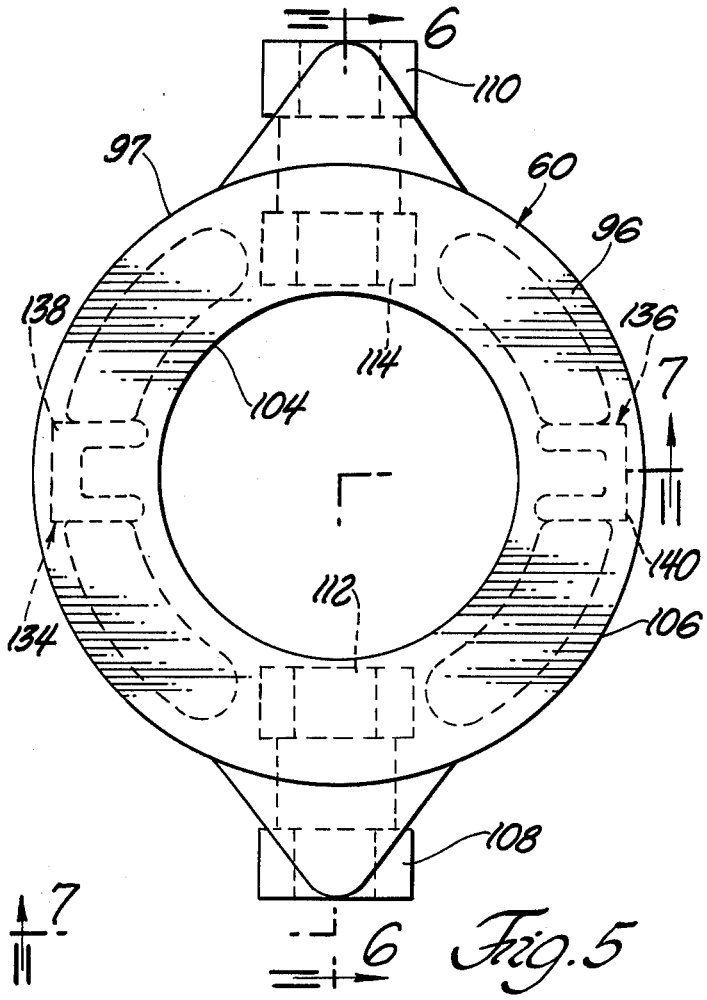
FIG. 5 is a top plan view of the piston means shown in FIGS. 1 and 2.
Figure 6:
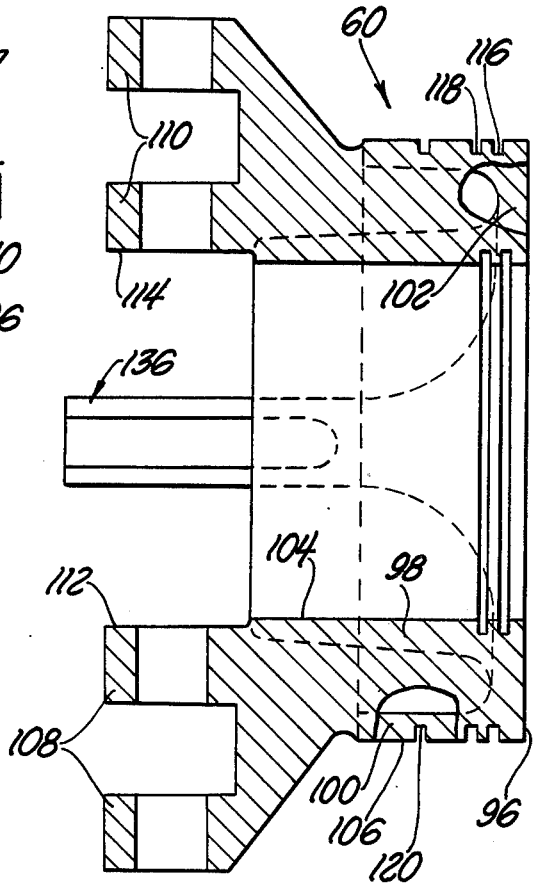
FIG. 6 is a cross-sectional view taken generally on the plane of line 6—6 of FIG. 5 and looking in the direction of the arrows.
Figure 7:
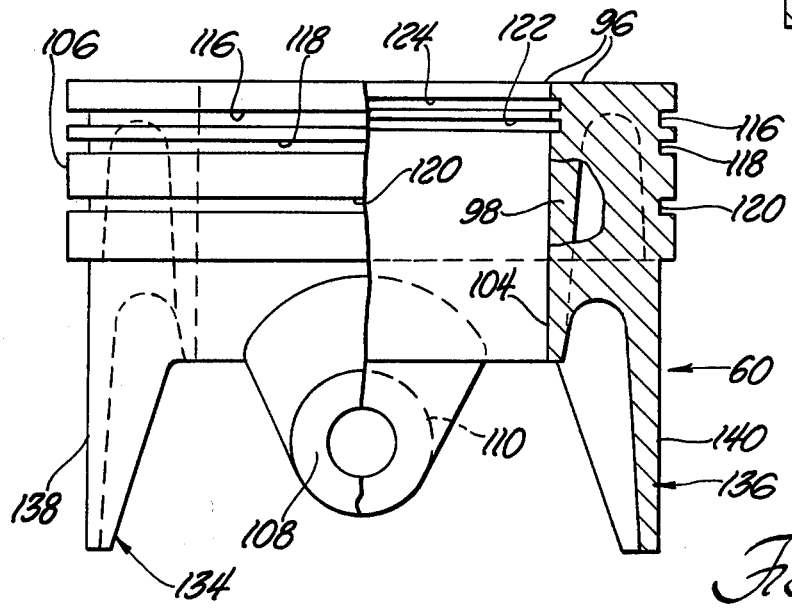
FIG. 7 is a partial cross-sectional and partial elevational view taken generally on the plane of line 7—7 of FIG. 5 and looking in the direction of the arrows.

Referring in greater detail to FIGS. 5, 6 and 7, wherein FIG. 5 may be considered as a view taken on the plane of the top surface 96 of the piston 60 in FIG. 2 and looking downwardly, the piston 60 is depicted as comprising a piston body 97 having inner and outer wall portions 98 and 100 integrally formed with an upper annular wall portion 102 respectively defining an inner cylindrical surface 104, outer cylindrical surface 106 and top working surface 96. As will be noted, the piston 60 has its connecting rod wrist pin journals or bearings 108 and 110 so arranged as to have the centerlines of such in alignment and passing through the axis of the piston body 97. Further, the radially inwardly disposed ends 112 and 114 of bearing portions 108 and 110 are situated as to be radially outwardly of the space defined, and confined, as by an extension or continuation of the inner cylindrical surface 104. A plurality of generally circumferential grooves 116, 118 and 120 serve to respectively contain the plurality of outer piston rings 88 while a second plurality of inner generally circumferential grooves 122 and 124 serve to respectively contain the plurality of inner piston rings 92.

As illustrated in FIG. 1, the piston means 60 may be operatively connected to the crankshaft means 28 as by connecting rods 126 and 128 and cooperating respective wrist pins 130 and 132.

Since, in the preferred embodiment, the piston means 60 is operatively mounted or connected to single crankshaft means 28, the piston 60 may tend to experience some tilting in its reciprocating movement causing a "piston slap" condition to occur. In order to prevent such occurrence, in the preferred embodiment, diametrically opposed axially elongated guide portions 134 and 136 are provided and preferably integrally formed with piston body 97 in a manner whereby the location of such guide portions, as viewed in FIG. 5, would be angularly between the axis of the wrist pin journals 108 and 110 and, further, would depend downwardly from the main body 97 as generally depicted in FIG. 7. Further, in the preferred embodiment, guide members 134 and 136 are respectively provided with flat outer guide surfaces 138 and 140 with such being parallel to each other and parallel to the axis of piston body 97.

With reference to FIG. 2, it can be seen that suitable sliding block or fixed guide means 142 and 144 are carried as by the engine housing section 18. Further, in the preferred form guide means 142 and 144 are respectively provided with flat guide surfaces 146 and 148 for respective sliding engagement with slidable or moving guide surfaces 138 and 140 of piston means 60. Such relatively fixed guide members 142 and 144 are preferably axially adjustable (as by threadable engagement with housing section 18, or the like) thereby being able to affect accurate operative engagement with surfaces 138 and 140 of guide portions 134 and 136; also suitable sealing means, as at 150, is preferably provided to effectively prevent leakage as from precompression chamber means 52. Further, suitable locking means, for example, threaded lock plugs or the like, as generally depicted at 152 and 154, may be employed for retaining the guide means 142 and 144 in any selected position. As should be apparent, especially from FIG. 2, if there is any tendency of piston 60 to experience any tilting about the axis of the wrist pins 130 and 132 during its reciprocating movement, such is slidably constrained by the coaction of guide surfaces 146 and 138, on one side, and guide surfaces 140 and 148 on the other side.

As shown in FIG. 1, engine housing portion 18 is preferably provided with relatively enlarged pockets or chamber portions 156, 158 as to be of a configuration and size adequate to respectively receive therein bearing portions 108 and 110 of annular piston means 60. Further, as best seen in FIG. 2, housing section 18 is also provided with pocket-like chambers or recesses 160, 162 which are situated generally diametrically opposite to each other (with reference to the axis of the piston means 60) and, preferably, angularly midway between chambers or recesses 156 and 158 (FIG. 1). Such chambers 160 and 162 may terminate, respectively, as in lower disposed wall portions 164, 166 with, preferably, wall portion 164 having aperture or passage means 168 formed therethrough.

As best illustrated in FIG. 2, housing section 18 is preferably also provided with interconnected oil reservoir chambers 170 and 172. Further, housing section 18 is preferably provided with a plurality of oil drain or return passages, one of which is depicted at 168, enabling such lubricating oil as is wiped from the piston means 60 and/or cylinder walls to be returned to the reservoir means of chambers 170 and 172. Further, an oil check aperture and plug means 174 may be provided as at an elevation slightly above the predetermined maximum oil level within chamber or reservoir means 170, 172. Obviously, if a pressurized or forced system of lubricating oil as for additional lubrication and/or coolng purposes, as for instance cooling the ring piston means 60 via an oil spray, is desired, such may be provided by any suitable means.

Referring in particular to FIG. 1 a plurality of passages 176 are formed, as in or by sleeve 84, as to have each of such provided with lower disposed open end 178 and an upper disposed open port 180 in, at times, communication with combustion chamber 80. Preferably, such passages 176 are generally equally circumferentially spaced from each other. As should be apparent, communication through the plurality of conduit or passage means 176 is initiated at the moment that piston means 60, in its downward movement, starts to uncover the respective ports 180. At or about the same time as piston means 60 starts to uncover or open ports 180, it also starts to uncover or open passage or orifice means 76 thereby enabling communication to be completed as between combustion chamber 80 and chamber or passage means 68 leading to the charge or pre-induction chamber means 52. As should be noted, when ports 180 are uncovered communication through passage means 176 as between combustion chamber 80 and the same charge or pre-induction chamber means 52 also occurs.

Because of the existence of two cylindrical surfaces, namely outer surface 94 and inner surface 90, within or defining the annular cylinder 78, a greatly increased or enlarged circumferential wall area becomes available as compared to the prior art "solid" or non-ring type piston and cylinder. The preferred embodiment of the invention makes it a practical possibility to, in effect, distribute many relatively small intake ports (180—180 and 76—76) in both ring cylinder walls or surfaces 94 and 90. This, in turn, enables the achievement of additional improvements as compared to the prior art.

Since many more intake ports may now be provided, it becomes possible to reduce the height (of the opening) of such intake ports in the order of magnitude of fifty percent (50%) or more as compared to the height (of the opening) of intake or inlet ports in conventional prior art engines especially such as are considered to be fast running two-stroke engines. An important advantage can consequently be obtained from being thusly able to reduce the height (of the opening) of the inlet and/or outlet ports. Generally, in a prior art conventional piston engine, the porting height averages one-third ($\frac{1}{3}$) of the total piston stroke. Accordingly, in such prior art engines, the result is that before the ports become fully closed, the piston has already traveled one-third ($\frac{1}{3}$) of its full stroke. Therefore, only two-thirds ($\frac{2}{3}$) of the total piston stroke remains available during which effective compression and expansion work can take place. Assuming, then, that in an engine, the teachings of the invention are employed and the porting height is reduced by fifty percent (50%), without restricting the intake or exhaust volume, the piston means, in its stroke, will travel only one-sixth (1/6) of its total stroke before the ports become closed. Consequently, the piston means has five-sixths (5/6) of its entire stroke in which to perform compression and expansion work.

Referring to FIG. 1, engine header housing 16, as generally depicted, fixedly seals and covers the outer and lower housing section 17 whereby the undersurface 182 covers the work area above the ring piston 60 as well as the upwardly (as viewed in FIG. 1) projected area of core means 66.

The upper end of the ring cylinder core means 66 is provided with an upper surface 184 of dished or concave configuration which is centrally situated and which, in turn, is effectively annularly surrounded by a ring-like or rim-like surface 186. In the preferred embodiment, the rim-like surface is generally sloped as to have its, for example, widest most end (or lower-most end as viewed in FIG. 1) terminating at a level or elevation as generally attained by the upper-most or working surface 96 of piston means 60 as it reaches its T.D.C. position. The rim surface 186 may have formed therein a pair of diametrically opposed notches or relieved portions 188 and 190 as to thereby provide for the necessary clearances for the valve heads 192 and 194 of exhaust valve means 196 and 198, respectively, during operation thereof. The ring-cylinder core or body 66 may be constructed of suitable heat-resisting metal which, in turn, can be adequately cooled as by the constant flow (as through passage means 68 and ports 76) of saturated air-fuel mixture. However, it is contemplated that the core means or body means 66, because of its inherent compactness, may be manufactured as to be comprised of highly refractory ceramic material or materials which, by far, have higher heat resistance and are thermally more stable than metal products or materials.

Still referring to FIG. 1, the generally under or inner side of engine header housing section 16 is provided with a dished or concave surface 200 which is so formed as to be situated in juxtaposed relationship to the concave end surface 184 of core or central body means 66. As depicted, the surfaces 184 and 200 are each concave but in directions opposite to each other thereby defining a combustion chamber 202 therebetween. As is clear in, for example, FIG. 1, an annular generally radiating space 204 is formed as between the annular rim-like surface 186 and the upper disposed surface 200 and/or surface 182.

Figure 4:
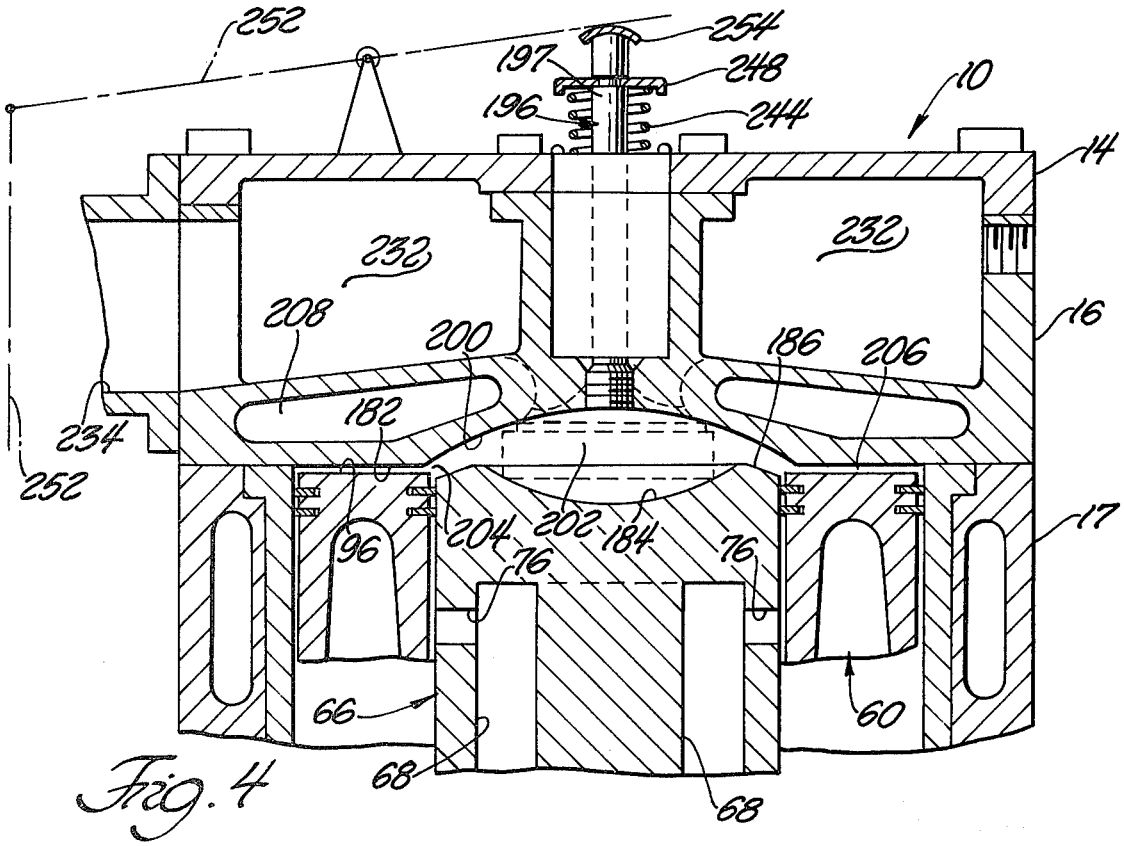
FIG. 4 is a relatively enlarged view illustrating a fragmentary portion of the structure as shown in FIG. 2 and depicting the ring piston in its top-dead-center position.

The undersurface 182 of header section 16 preferably of a configuration and/or pattern as to be at least closely reflective of the configuration and/or pattern of the upper working surface 96 of piston means 60. In so doing there is assurance that when piston means 60 moves upwardly and reaches its T.D.C. position, as depicted in FIG. 4, an effective squish area or space 206 will be created and will exist as between piston surface 96 and undersurface 182 of housing section 16.

Referring to FIG. 1, suitable cavity means 208 may be formed in engine housing head section 16 and, similarly, cavity means 210 may be formed in engine housing section 17 with such being operatively interconnected as by internal or, as shown, external conduit means 212. A suitable coolant liquid may be pumped through such cavities and withdrawn as by conduit 214 and pump 216 to be subsequently cooled as to atmosphere through suitable heat exchanger means 218 and returned to the coolant cavities as by conduit means 220.

A plug or nozzle means 222 is illustrated as being operatively carried as by housing section 16 in a manner as to be in communication with combustion chamber 202 and 80. Member or means 222 is referred to as a "plug" or "nozzle" means in that such may be an ignition spark plug or igniter in an engine 10 where such are required to initiate combustion of the combustible mixture within the combustion chamber means, or such may be, for example, suitable fuel injection nozzle means if the engine 10 is intended to operate, for example, as a diesel. If such elements are in fact spark plugs, their operation is, of course, timed with respect to the movement of the piston means 60 as by any suitable means (not shown), many of which are well known in the art.

Figure 3:
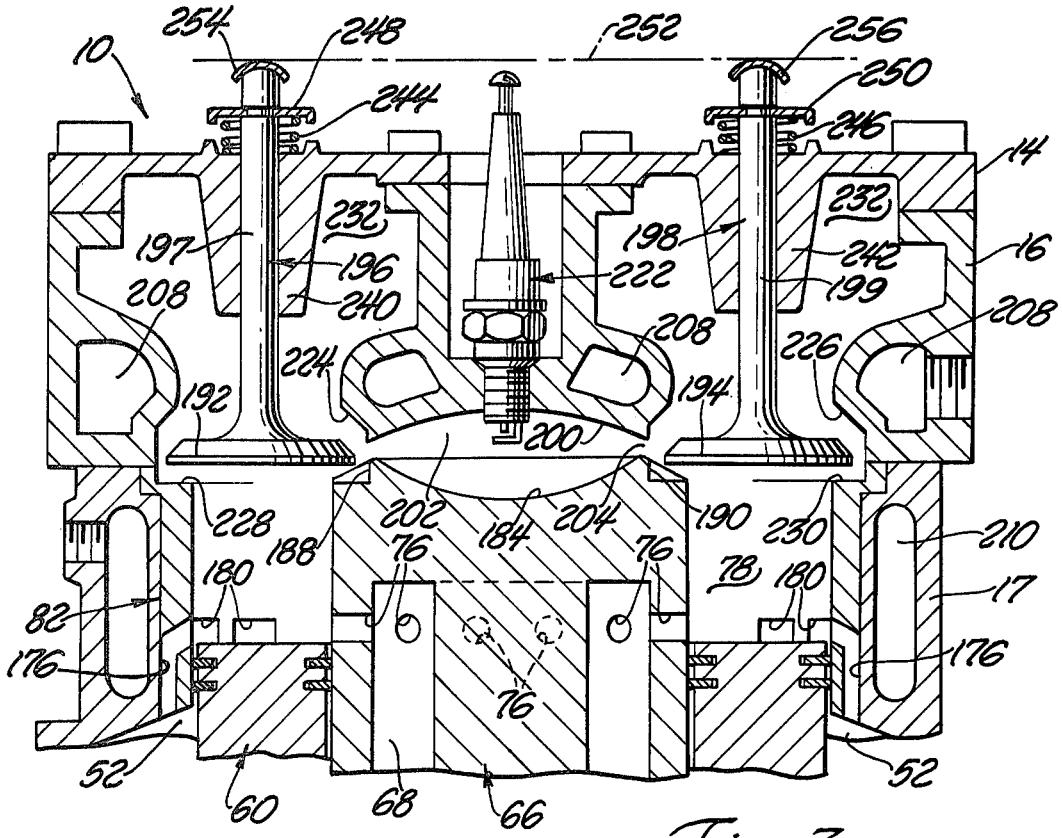
FIG. 3 is a view illustrating a fragmentary portion of the structure of FIG. 1 with certain of the elements therein being depicted in an operating position different from that of FIG. 1.

As illustrated in FIGS. 1 and 3, housing section 16 is provided with, preferably, a pair of valve seats 224 and 226 defining orifices and serving as respective seats for the valve heads 192 and 194 of valving means 196 and 198. As depicted in FIG. 1, the valve means 196 and 198 are each in a closed position while in FIG. 3, each are in an open position. As shown in both FIGS. 1 and 3, generally oppositely disposed to relieved portions or clearances 188 and 190 are functionally similar clearances or relieved portions 228 and 230, formed in sleeve 82, which, if needed, will provide for the necessary space to accommodate the valve heads 192 and 194 during movement thereof.

Referring to each of FIGS. 1, 2, 3 and 4, housing section 14, sealingly secured as atop engine housing section 16, serves to provide a plenum-like chamber 232 which communicates with combustion chamber 80 in timed relationship as by the opening and closing of valve means 196 and 198. An exhaust chamber or passage 234, as generally depicted in FIGS. 2 and 4, also communicates with plenum chamber 232. As generally depicted in FIGS. 1 and 4, for satisfactory efficiency, the plenum-like chamber means 232 may have a volumetric capacity in the order of five times, or even more, the displacement of piston means 60. As illustrated, preferably, housing section 16 is provided with a recess 236 for the reception therein of plug or nozzle means 222 while housing means 14 is provided with an access aperture 238 permitting access to means 222.

As shown in, for example, FIGS. 1 and 3, valve stem guides 240 and 242, provided as by housing section 14, sealingly and slidingly receive the stems 197 and 199, respectively, of valve means 196 and 198. Respective springs 244 and 246 cooperating with respective movable spring seats 248 and 250 carried by valve stems 197 and 199 serve to resiliently urge valve means 196 and 198 in an upward direction (as viewed in FIGS. 1 and 3) toward a position where respective valve heads 192 and 194 are sealingly closed against cooperating valve seats 224 and 226. As is generally diagrammatically or schematically illustrated, the opening of the valve means 196 and 198 is affected as by cam means and related and associated motion transmitting means 252 operatively connected as to both valve rocker means 254 and 256 and driven as by, for example, the crankshaft means 28. Many valve timing and operating mechanisms and means are well known in the art and the practice of the invention is not limited to the employment any particular valve operating arrangement.

It is also contemplated that in certain situations and embodiments of the invention it may be desired that the engine 10 be operated as in conjunction with a booster or supercharger means or be operated on a diesel cycle. In such situations, it is preferred that certain engine accessory means be provided. For example, referring in particular to FIG. 2, blower or compressor means 258 is shown having its intake in communication with a source of ambient air as through related suitable air cleaner or filter means 260. Such air compressor means 258 may be operatively driven as through related drive train or motion transmitting means 262 operatively connected as to output shaft or crankshaft means 28 of engine assembly 10. The compressed air output of blower means 258 is directed to conduit means 264 which simultaneously supplies suitable related metering valve means 266 and a second related metering valve means 268. Suitable back-pressure or check valve means such as, for example, a reed-type valve assembly 270, communicating with chamber 52 of the engine housing 18, is supplied with air from metering valving means 266 via conduit means 272. In the event the engine 10 is to be carburetor fed, a carburetor means 274 may be combined with valving means 266. The air supplied to and through valving means 268 is directed as through suitable conduit means 276 into the plenum-like chamber 232 which then serves as an efficient afterburner due to the introduction of a metered quantity of ambient oxygen which is thereby forcefully injected into said chamber 232. The oxygen thusly supplied to chamber 232 mixes with the hot exhaust gases therein and serves to sustain further combustion of the otherwise not completely burned exhaust gases before such exhaust is released to ambient atmosphere.

OPERATION OF INVENTION

For purposes of description, let it be assumed that the engine 10 is running and, that at this first moment of consideration piston means 60 is at its B.D.C. position as generally depicted in FIGS. 1 and 2 and, further, that the combustion chamber 80 is filled with a combustible mixture or motive fluid. From this point, because of the rotation of crankshaft means 28, both connecting rods 126 and 128 start to experience a lifting or upward (as viewed in FIGS. 1 and 2) motion which, in turn, is transmitted to the piston means 60 causing it to start to move upwardly toward its T.D.C. position.

As the piston 60 thusly starts its upward movement, it, in moving, progressively closes inlet ports 180 and 76 each of which communicates with chamber 52 as, respectively, via passage means 176 and 68. Preferably, ports 180 and 76 are not located as to be in juxtaposed or radially aligned relationship but rather so located as to be in a generally angularly staggered relationship so that, for example, the fuel-air mixture being supplied by a port 76 would impinge as upon a portion of the opposite wall between ports 180 and, similarly, the fuel-air mixture supplied by a port 180 would impinge as upon a portion of the wall between ports 76. The fuel-air mixture, provided in such a flow pattern would better provide a cooling effect upon contacting the cylinder walls.

In the preferred embodiment inlet ports 180 and 76 are so located or positioned as to be completely opened when piston means 60 reaches its B.D.C. position as depicted in FIG. 1. As should now be apparent, the invention enables the use of a relatively large number of inlet or intake ports; that is, it becomes possible to provide a plurality of such inlet ports 180 along the circumference of the outer cylinder wall and a plurality of inlet ports 76 along the circumference of the inner cylinder wall. As a consequence thereof the invention further enables the use or employment of relatively low (horizontally narrow) inlet ports and still obtain an adequate total inlet port area which will result in meeting unrestricted flow-through requirements. Consequently, it becomes possible, and in fact relatively easy, to reduce porting height (as compared to prior art engines) in the order of at least 50% without effecting the porting efficiency. This, in turn, provides a gain in added useful piston stroke because the lower port height is, the quicker the combustion chamber be sealed by the movement of the piston as it moves from its B.D.C. toward its T.D.C. position thereby trapping a larger air-fuel volume to be compressed, as compared to the prior engines where higher porting must be provided.

As should now be apparent, with exhaust valves 196 and 198 closed and with inlet ports 180 and 76 becoming closed by the upward movement of piston means 60, further continued upward movement of piston means 60 causes a progressively decreasing volume of the combustion chamber 80 and, concomittantly, the combustible mixture therein becoming highly compressed.

When the piston 60 reaches its T.D.C. position, as generally depicted in FIG. 4, the top working surface 96 of piston means 60 is brought to a very closely spaced relationship with respect to the juxtaposed cylinderhead surface 182 resulting in a very narrow annular gap 206 therebetween with such gap 206 being referred to as a squish band. The squish band, in turn, causes a squish and swirl of the highly compressed fuel-air mixture with such being directed generally radially inwardly or, generally, towards the central axis of the ring cylinder 78. More specifically, the fuel-air mixture is forced, at a great speed, to flow through the annular gap 204 and over the annular rim surface 186 into the combustion chamber portion 202, with such flow being highly agitated and multi-directional. The fuel-air mixture thusly flowing into combustion chamber portion or section 202 is then, effectively, instantaneously ignited as by, for example, igniter means 222.

Generally, it is known in the art of conventional prior art engines employing conventional (non-ring type) pistons and conventional (non-ring type) cylinders that a squish area can be formed peripherally about the piston's top working surface with such squish area cooperating with, for example, a generally domed cylinder head. Generally radially inwardly of such squish area, the piston is provided with a relieved portion forming a cavity-like portion. In such prior art structures, it has been proposed to provide such squish area to be substantially less than a complete annular ring or surface about the top of the piston with the ratio thereof being in the order of 50% of the annular area about the top of the piston being provided with a squish band the other remaining 50% being relieved as to provide for flow.

Even though the general concept of a squish band, theoretically, provides for increased efficiency, in practice and as proposed by the prior art, the employment of a squish band in conventional (non-ring type pistons and cylinders) engines fails to produce a noticable improvement over other prior art more conventional combustion chamber configurations. In the prior art, although the squish band has a theoretical value, it is believed that its real value is significantly undone by the fact that the piston is a moving object and thus it changes, at great speed (as it moves), those critical shapes and relationships necessary for an effective squish band and associated combustion chamber. For example, considering such a prior art solid (non-ring type piston and cylinder) piston provided with the proposed prior art type squish band and its movement from its B.D.C. to T.D.C. position, usually when such piston reaches a position of 40° to 30° before T.D.C. the related spark advance initiates the ignition of the fuel-air mixture within the cylinder combustion chamber. However, at the instant of such ignition, the piston is still moving in its compression stroke and the fuel compression ratio is not fully achieved. Also, at this time, the piston has not reached a position whereat the squish band becomes effective even though ignition is initiated. By the time that the piston reaches its T.D.C. position approximately 76% of the combustion process is completed and, therefore, unfortunately, the squish band of the prior art becomes effective only at a time when little combustible mixture remains with which to continue the burning or combustion process. Such a shortcoming of the prior art can be better understood if one considers, for example, the sequence of events of, for example, a conventional prior art solid (non-ring type) piston engine having a piston stroke of 3.0 inches and a compression ratio of 10:1 with such piston being provided with a squish band of, for example, 50% of the cylinder bore. Further, let it be assumed that the squish gap height is 0.06 inch (or between 1.0 to 2.0 mm.) and that the spark (ignition) advance is set at 40° before T.D.C. A piston with a stroke of 3.0 inches, still has to travel a distance of 0.33 inch to reach its T.D.C. position from its 40° before T.D.C. position. At the 40° advance position, the combustion chamber is only partially compressed and the combustible mixture therein experiences a compression ratio of only 4.5:1. Further, it can be seen, under the assumed conditions, that when the piston is still 0.33 inch away from its T.D.C., the squish gap (distance between the squish band or surface carried by the piston and juxtaposed portion of the combustion chamber) is the total of the total distance to be traveled by the piston to reach its T.D.C. position and the squish gap height at T.D.C. (0.33 inch+0.06 inch) or 0.39 inch high and, therefore, ineffective at that moment even though combustion has been initiated. Although the piston velocity towards T.D.C. is high, the burning or combustion process progresses at even a faster rate. Therefore, it should be apparent that in the proposals of the prior art, the ideal or necessary conditions for enabling the squish band of the prior art to become effective and efficient never really materialize.

The invention as herein disclosed provides additional benefits and overcomes or at least greatly minimizes problems which exist in prior art engines of conventional combustion chambers with or without a squish band. This, generally relates to and arises from the necessity of a spark advance, that is, the initiation of the combustion process prior to the piston reaching its T.D.C. position. It should be apparent that in such prior art engines, from the moment that ignition is initiated up to the time that the piston reaches its T.D.C. (for example from 320° to 360° crankshaft rotation) the piston not only has to expend the force and energy necessary to achieve the (assumed) compression of 10:1 (at T.D.C.) but also has to overcome the counterforce produced by the burning combustible mixture immediately following ignition. Such counterforce rapidly increases in magnitude during the time that the piston is still moving toward its T.D.C. As is apparent, because of such forces resisting the movement of the piston toward its T.D.C., relatively high energy losses occur. However, the inventive concepts and teachings disclosed by the invention enable the attainment of substantial and significant improvements over such prior art engines and their attendant problems. In this connection, reference is again made to FIGS. 1 and 2 as well as to FIGS. 8, 9 and 10.

As already generally described, ring piston means 60 is slidably movable within annular ring cylinder 78 defined as by the outer ring cylinder wall or surface 90 and the inner ring cylinder wall or surface 94. The inner cylinder wall or surface 94 is carried by the inner ring cylinder section 66 which is centrally fixedly mounted and is of a structural strength sufficient to withstand the explosive forces generated above its top or end surfaces 184 and 186. Preferably, top or end surface 184 is of a generally concave configuration terminating, at its outer periphery, as in a ring-like rim surface 186. The cylinder head may, in fact, be an integral part of the housing section 17.

A second generally concave configuration 200 is formed well within the cylinder head as to be juxtaposed and opposed to the concave surface 184. In the preferred embodiment, surface 200 extends radially outwardly a distance sufficient as to generally, in spaced relationship, overlap the rim surface 186 of cylinder core 66 thereby defining a relatively narrow (in terms of spaced relationship between surfaces 200 and 186) totally circumferential communication gap 204 thereby providing for continuous communication as between chamber 202 (defined by surfaces 200 and 184) and cylinder chamber 80 above the working surface 96 of piston means 60.

Figure 8:
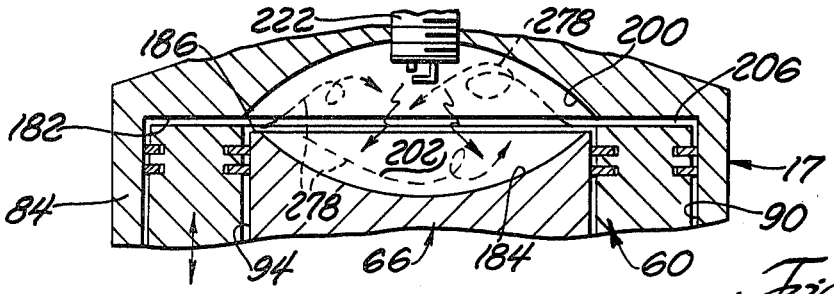
FIG. 8 is a fragmentary cross-sectional view, somewhat similar to a portion of the structure shown in FIG. 4 but illustrating another embodiment of the invention.

In FIG. 8, the piston 60 is depicted in its T.D.C. position occupying all of chamber 80 except the very small ring-like gap 206 between the working surface 96 of piston 60 and the cylinder head surface 182. The annular gap 206, in this instance, with piston 60 at T.D.C., constitutes a highly efficient squish band. At this point, as somewhat pictorially depicted by the dash-line arrows 278, the fuel-air mixture within the combustion chamber portion 80 has been, except for the very small annular volume of annular gap 206, squished and swirled into combustion chamber portion 202 which is, in fact, a stable and unexpandable combustion chamber section. In such an arrangement, and in the preferred embodiment thereof, the igniter means 222 would be timed as to initiate ignition of the combustible mixture with combustion chamber means just the moment prior to piston means 60 reaching its T.D.C. position.

Figure 9:
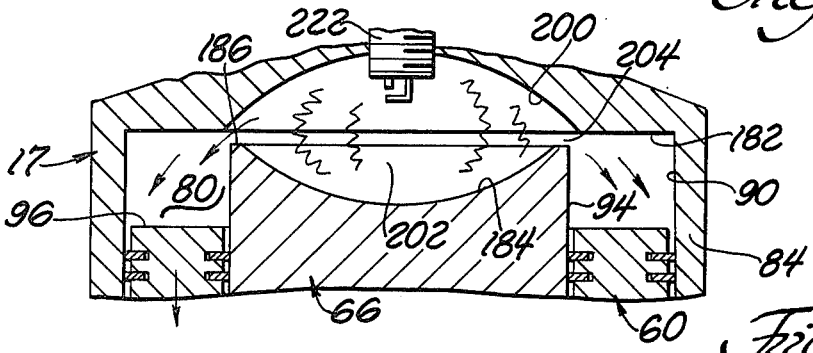
FIG. 9 is a view similar to that of FIG. 8 but depicting one of the elements in an operating position different from that of FIG. 8.

As depicted in FIG. 9, the ring piston 60 is moving downwardly and the fast-expanding hot gases, resulting from the burning combustible mixture, are leaving (flowing from) the unexpandable combustion chamber means 202 and, with full force, driving the piston means 60 downwardly.

Figure 10:
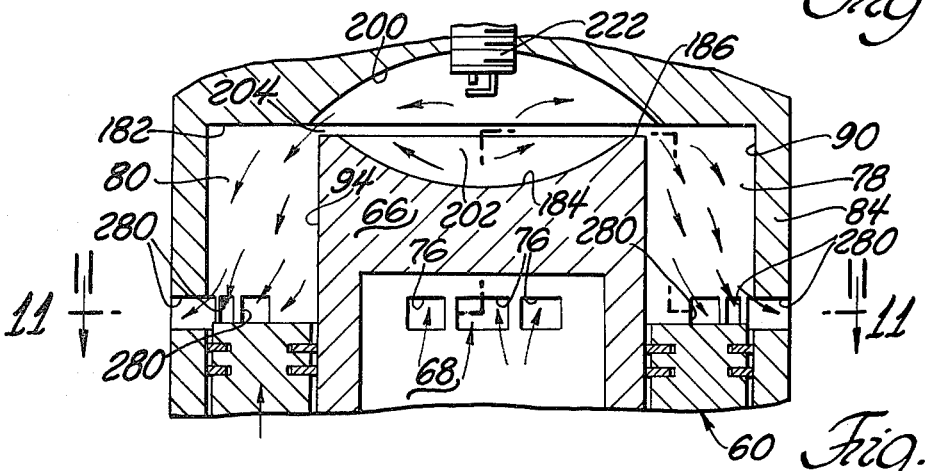
FIG. 10 is a view similar to that of FIGS. 8 and 9 but depicting the ring piston in its bottom-dead-center position.
Figure 11:
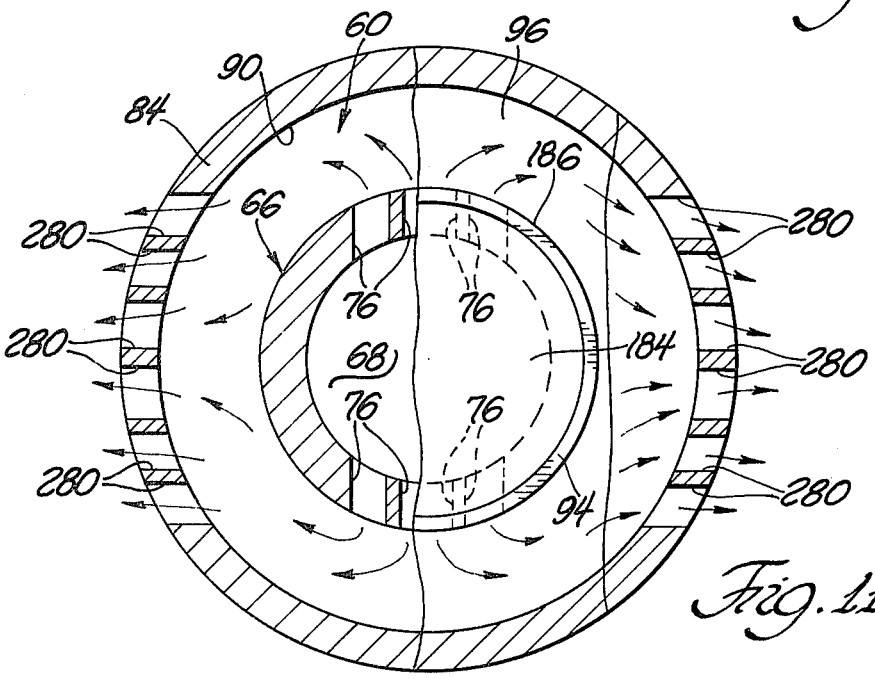
FIG. 11 is a cross-sectional view taken generally on the plane of line 11—11 of FIG. 10 and looking in the direction of the arrows.

FIG. 10 illustrates the piston means 60 in its B.D.C. position having, at that time, uncovered all ports 76 and 280. Ports 280, formed as through outer wall 84 of the ring cylinder 78 depict exhaust ports which communicate with ambient as through associated exhaust conduit or passage means (not shown). In the embodiment contemplated by FIG. 10, no exhaust valves, as valves 196 and 198 of FIGS. 1, 2, 3 and 4, are provided for direct scavenging of exhaust gases into a plenum chamber. Instead, FIGS. 10 and 11 illustrate a valveless scavenging system wherein all ports 76 leading into the cylinder chamber 80 from the inner core or body portion 66 are employed as conduit or passage means for delivering the pre-compressed fuel-air mixture from chamber 52 (as in FIG. 1) into the cylinder combustion chamber portion 80 during the time that ports 76 are uncovered (effectively opened) by piston means 60. All ports or passages 280, provided in the outer wall of the ring cylinder 78 are exhaust passage or conduit means effectively communicating between cylinder 78 and, for example, ambient for the release of exhaust gases during the time that ports 280 are uncovered (effectively opened) by piston means 60.

It has been discovered that an extremely efficient arrangement of porting means, in a valveless scavenging system, is achieved by arranging the air and gas flow, during the exchange of gases, as to have a flow pattern as generally depicted by the flowing-like arrows of FIG. 11. In the preferred embodiment, such scavenging is based on a crosswise enter-exit pattern. More particularly, in the preferred embodiment of the arrangement of FIG. 11, a first plurality of inlet ports 76 would be formed as to have the direction of flow thereof generally in planes parallel to each other, as viewed in FIG. 11; a second plurality of inlet ports 76 would also be formed as to have the direction of flow thereof generally in planes parallel to each other, also viewed in FIG. 11. Such first plurality of ports 76 would be formed on, generally, one diametral side of core body means 66 while the second plurality of ports 76 would be formed on, generally, the opposite diametral side of core or body means 66. Further, in the preferred arrangement, the respective ports comprising the first plurality of ports 76 would be in alignment, as viewed in FIG. 11, with the respective ports comprising the second plurality of ports 76. Still further, in the preferred embodiment of the arrangement of FIG. 11, a first plurality of exhaust ports 280 would be formed as to have the direction of flow through generally in planes parallel to each other, as viewed in FIG. 11; a second plurality of exhaust ports 280 would also be formed as to have the direction of flow thereof generally in planes parallel to each other, also as viewed in FIG. 11. Such first plurality of exhaust ports 280 would be formed on, generally, one diametral side of outer cylinder wall 84 while the second plurality of exhaust ports 280 would be formed on, generally, the opposite diametral side of outer cylinder wall 84. Also, in the preferred arrangment, the respective ports comprising the first plurality of exhaust ports 280 would be in alignment, as viewed in FIG. 11, with the respective ports comprising the second plurality of exhaust ports 280. Further, it would be preferred that such planes containing the direction of flow through inlet ports 76 be normal (as viewed in FIG. 11) to the planes containing the direction of flow through exhaust ports 280. Consequently, as generally depicted by the flowing-like arrows of FIGS. 10 and 11, the fuel-air mixture from chamber 52 flows into chamber or passage means 68 and through ports 76 being directed generally toward the outer cylindrical surface 90 and rising upwardly (as viewed in FIG. 10) in a loop-like pattern partly into the central unexpandable combustion chamber 202 scavenging that area and then exiting chamber 202 and flowing generally into the chamber area 80, in a down-flow pattern further scavenging all prior burned gases as to cause such to exit through the open exhaust ports 280.

As should now be apparent, the centrally contained combustion chamber 202 does not change either its shape or volume at any given time. By constructing the chamber 202 of generally spherical-like surfaces it becomes possible to either closely approximate or attain an ideal surface-to-volume (S/V) ratio for it. The S/V ratio can be further improved when a plenum chamber, such as at 232 of FIGS. 1, 2, 3 and 4, is provided for the further treating of the exhaust gases.

The invention makes it possible to locate the igniter or nozzle means 222 exactly in the center thereby resulting in the flame propagation being most evenly distributed. Since the flame propagation works in conjunction with a ring piston, the entire working surface 96 of the piston 60 becomes effective for creating a very large squish band 206 (FIG. 4); this, in turn, means that, for example, in the order of at least 90% of the combustible fuel-air mixture (to be ignited) must be squeezed into and collected within the adjacent combustion chamber portion 202 wherein such motive fluid is thoroughly burned before the resulting hot expanding gas is released into the area of the combustion chamber portion 80 where it can exert its full force against the ring piston 60. Thus it can be seen that the combustion chamber portions, that is the chamber portion 202 as defined by opposed generally confining surfaces as depicted in, for example, FIGS. 1, 2, 3, 4, 8, 9 and 10 and the ring or annular chamber portion 80 as depicted in, for example, FIGS. 1, 2, 3, 4, 8, 9 and 10, each comprise working or work combustion chambers in that the ignition of the combustible mixture in each and the consequent expansion of the resulting gases produce a working or work pressure and force against the work or top surface of the ring-like piston.

Consequently, it can be seen that the initial suddenly released force occurring at time of ignition will effectively cushioned and generally absorbed first within the unexpandable combustion chamber means 202 and only then, after nearly all the burning is completed, the resulting heat expansion of the gases acts upon the ring piston 60; therefore, the piston 60 is not subjected to direct exposure of any violet and sudden stress impact in the entire cycle. This, in turn, will increase the overall fuel efficiency, provide a much smoother running engine and assure a longer life span to many of the engine components.

It is also contemplated that further benefits may be obtained by having the cylinder core or body means 66 comprised of suitable ceramic material of high heat resistance and with a generally stable heat expansion factor. In the practice of the invention wherein the body means 66 was thusly comprised of ceramic, it would not be necessary to provide any special cooling for the body means 66 since such could be considered an exceptionally efficient adiabatic heat conserving feature.

Prior art attempts at employing ceramics in engines has met with unsatisfactory results. The main problem encountered by the prior art was (and is) the incompatibility of combining ceramic components with surrounding metal components, and/or having the ceramic material in a thin wall configuration, and/or using the ceramic material to form moving components such as a piston or the like. However, in the invention, the use of a ceramic material for the fabrication of the core body means 66 becomes possible because it encounters none of the disadvantages experienced as where prior art components are merely being converted to ceramic material. The inner core or body means 66 can be of a single compact mass and can be securely set in position as at its bottom end and permanently fastened with unsophisticated means. Because of the compactness, which body means 66 can assume, the ceramic material comprising means 66 can withstand, on its own, all of the attendant heat and sudden pressure peaks without danger of failure. Preferably, the ceramic would have a low coefficient of thermal expansion and any slight degree of expansion thusly experienced would create no problem since the core or body means 66 would be able to expand axially without impairing any of the benefits of the invention. Various ceramics may be employed as, for example, all ceramics of alumina fused, alumina hydrated, silicon carbide, reaction-bonded silicon nitrides, hot-pressed silicon nitride and sintered nitrides, such comprising but a few of the ceramics employable in forming the core means 66, if desired.

Although only a preferred embodiment and selected modifications of the invention have been disclosed and described it is apparent that other embodiments and modifications are possible within the scope of the appended claims.

What is claimed is:

1. An internal combustion engine, comprising an engine housing, an annular cylinder formed in said housing, said annular cylinder comprising a first radially inner annular wall and a second radially outer annular wall, a stationary axial end surface means operatively joined to said first radially inner annular wall, a ring-like piston received in said annular cylinder for reciprocating movement therein, motion transmitting means operatively connected to said ring-like piston for transmitting the reciprocating movement of said ring-like piston to associated power output means, work combustion chamber means, said work combustion chamber means comprising a first ring-like work combustion chamber defined generally and cooperatively by said inner and outer annular walls and said piston, said work combustion chamber means further comprising a second work combustion chamber situated generally axially of said first ring-like work combustion chamber, said first and second work combustion chambers being in continuous open communication with each other and effective for receiving a combustible mixture therein, said ring-like piston when moving in a direction toward its top-dead-center position being effective for simultaneously compressing said combustible mixture within both of said first and second work combustion chambers, said second work combustion chamber being of unexpandable volume and in part defined by said stationary axial end surface means, means for initiating ignition of said combustible mixture first within said second work combustion chamber and only thereafter causing ignition of said combustible mixture to travel from said second work combustion chamber to within said first work combustion chamber to thereby through such combustion and expansion of said combustible mixture collectively within both said first and second work combustion chambers produce a work pressure against said ring-like piston in order to move said ring-like piston toward its bottom-dead-center, and annular passage means generally peripherally about said second work combustion chamber for completing said continuous communication, wherein said annular passage means is peripherally continuous about said second work combustion chamber, wherein said radially inner annular wall is fixedly supported by a bearing riser portion to said engine housing.

2. An internal combustion engine according to claim 1 wherein said means for initiating ignition comprises igniter means effectively in said second work combustion chamber, said igniter means being effective for igniting first any combustible mixture within said second work combustion chamber.

3. An internal combustion engine according to claim 1 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

4. An internal combustion engine according to claim 1 wherein said second work combustion chamber comprises first and second combustion-chamber surface means, wherein said first and second combustion-chamber surface means are spaced from each other, wherein said stationary axial end surface means comprises one of said first and second combustion-chamber surface means, and wherein said first combustion-chamber surface means is generally concave.

5. An internal combustion engine according to claim 4 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

6. An internal combustion engine according to claim 1 and further comprising piston guide means, said guide means comprising first and second guide portions carried by said ring-like piston and third and fourth guide portions carried by said engine housing, said first and third guide portions being in operative engagement with each other during said reciprocating movement of said ring-like piston, and said second and fourth guide portions being in operative engagement with each other during said reciprocating movement of said ring-like piston, said first and third guide portions and said second and fourth guide portions serving to at least inhibit said ring-like piston from experiencing piston slap during said reciprocating movement.

7. An internal combustion engine according to claim 6 wherein said first and second guide portions comprise first and second surface extensions extending from said ring-like piston in a direction generally toward said crankshaft means, wherein said first surface extension is on one side of said crankshaft means and said second surface extension is on a side of said crankshaft means opposite to said one side when said first and second surface extensions and said crankshaft means are viewed in a cross-sectional plane passing generally transversely through said crankshaft means, said first and third guide portions and said second and fourth guide portions respectively cooperating to preclude said ring-like piston from tilting with respect to the axis of said first ring-like combustion chamber portion.

8. An internal combustion engine according to claim 7 wherein said third and fourth guide portions respectively comprise first and second slidable guide members carried by said engine housing.

9. An internal combustion engine according to claim 8 wherein each of said first and second slidable guide members is adjustably threadably mounted with respect to said engine housing.

10. An internal combustion engine according to claim 1 and further comprising exhaust valve means effective to at times enable the flow of gases burned in said combustion chamber means to be exhausted therefrom, and a plurality of intake ports for enabling the flow of a combustible mixture directly into said first work combustion chamber when said intake ports are uncovered by said ring-like piston during said reciprocating movement thereof, said plurality of intake ports comprising a first plurality of ports formed in said first radially inner annular wall and a second plurality of ports formed in said second radially outer annular wall.

11. An internal combustion engine according to claim 10 wherein said exhaust valve means are operated in timed relationship to the rotation of said crankshaft means.

12. An internal combustion engine according to claim 10 and further comprising pre-compression chamber means for receiving a combustible mixture therein, and passage means interconnecting said intake ports and said pre-compression chamber means.

13. An internal combustion engine according to claim 1 wherein said second work combustion chamber comprises a generally concave surface when viewed from the interior of said second work combustion chamber, and further comprising an annular rim surface, said generally concave surface extending as to peripherally generally terminate in said annular rim surface, and wherein said rim surface defines one side of said annular passage means for enabling said continuous communication between said first work combustion chamber and said second work combustion chamber.

14. An internal combustion engine according to claim 13 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

15. An internal combustion engine according to claim 13 and further comprising exhaust valve means effective to at times enable the flow of gases burned in said combustion chamber means to be exhausted therefrom, and a plurality of inlet ports for enabling the flow of a combustible mixture directly into said first work combustion chamber when said inlet ports are uncovered by said ring-like piston during said reciprocating movement thereof, said plurality of inlet ports comprising a first plurality of ports formed in said first radially inner annular wall and a second plurality of ports formed in and generally circumferentially about said second radially outer annular wall.

16. An internal combustion engine according to claim 15 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

17. An internal combustion engine according to claim 1 and further comprising generally centrally disposed axially extending stationary core-like body means, wherein said first radially inner annular wall is carried by said stationary core-like body means, wherein said second work combustion chamber comprises first and second combustion-chamber surfaces, wherein said first combustion-chamber surface comprises said stationary axial end surface means and is situated at the axial end of said stationary core-like body means, and wherein said second combustion-chamber surface is carried by said engine housing as to be spaced from and generally juxtaposed to said first combustion-chamber surface.

18. An internal combustion engine according to claim 17 wherein said first combustion-chamber surface is generally concave when viewed from the interior of said second work combustion chamber.

19. An internal combustion engine according to claim 17 wherein said first and second combustion-chamber surfaces are each of a generally concave configuration with the concavity thereof being in opposed directions when viewed from the interior of said second work combustion chamber.

20. An internal combustion engine according to claim 17 wherein said first combustion-chamber surface comprises a concave surface of a generally spherical configuration when viewed from the interior of said second work combustion chamber.

21. An internal combustion engine according to claim 17 wherein said second combustion-chamber surface comprises a concave surface of a generally spherical configuration when viewed from the interior of said second work combustion chamber.

22. An internal combustion engine according to claim 17 wherein each of said first and second combustion-chamber surfaces comprises a concave surface of a generally spherical configuration when viewed from the interior of said second work combustion chamber.

23. An internal combustion engine, comprising an engine housing, an annular cylinder formed in said housing and having a central axis, said annular cylinder comprising a first radially inner wall and a second radially outer annular wall, a ring-like piston received in said annular cylinder for reciprocating movement therein, said ring-like piston comprising a ring-like working surface means, said first and second annular walls and said working surface means comprising combustion chamber means, motion transmitting means operatively connected to said ring-like piston for transmitting the reciprocating movement of said ring-like piston to associated power output means, exhaust valve means located above said first and second walls effective to at times enable the flow of gases burned in said combustion chamber means to be exhausted therefrom, and a plurality of intake ports spaced from said exhaust valve means for enabling the flow of a combustible mixture into said combustion chamber means when said intake ports are uncovered by said ring-like piston during said reciprocating movement thereof, said plurality of intake ports comprising a first plurality of ports formed in said first radially inner annular wall effective for permitting a flow of said combustible mixture in a direction generally away from said central axis and into said combustion chamber means, and a second plurality of ports formed in said second radially outer annular wall effective for permitting a flow of said combustible mixture in a direction generally toward said central axis and into said combustion chamber means simultaneously with said first plurality of ports.

24. An internal combustion engine according to claim 23 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

25. An internal combustion engine according to claim 23 wherein said exhaust valve means are operated in timed relationship to the rotation of said crankshaft means.

26. An internal combustion engine according to claim 23 and further comprising pre-compression chamber means for receiving a combustible mixture therein, and passage means interconnecting said intake ports and said pre-compression chamber means.

27. An internal combustion engine according to claim 23 and further comprising piston guide means, said guide means comprising first and second guide portions carried by said ring-like piston and third and fourth guide portions carried by said engine housing, said first and third guide portions being in operative engagement with each other during said reciprocating movement of said ring-like piston, and said second and fourth guide portions being in operative engagement with each other during said reciprocating movement of said ring-like piston, said first and third guide portions and said second and fourth guide portions serving to at least inhibit said ring-like piston from experiencing piston slap during reciprocating movement.

28. An internal combustion engine according to claim 27 wherein said first and second guide portions comprise first and second surface extensions extending from said ring-like piston in a direction generally toward said crankshaft means, wherein said first surface extension is on one side of said crankshaft means and said second surface extension is on a side of said crankshaft means opposite to said one side when said first and second surface extensions and said crankshaft means are viewed in a cross-sectional plane passing generally transversely through said crankshaft means, said first and third guide portions and said second and fourth guide portions respectively cooperating to preclude said ring-like piston from tilting with respect to the axis of said combustion chamber portion.

29. An internal combustion engine according to claim 28 wherein said third and fourth guide portions respectively comprise first and second slidable guide members carried by said engine housing.

30. An internal combustion engine according to claim 29 wherein each of said first and second slidable guide members is adjustable threadably mounted with respect to said engine housing.

31. An internal combustion engine according to claim 23 wherein said combustion chamber means comprises a first ring-like work combustion chamber defined generally and cooperatively by said inner and outer annular walls and said ring-like piston, said combustion chamber means further comprising a second work combustion chamber situated generally axially of said first work combustion chamber, said first and second work combustion chambers being in continuous communication with each other, said second work combustion chamber being of unexpandable volume, said second work combustion chamber comprising first and second combustion-chamber surface means, wherein said first and second combustion-chamber surface means are spaced from each other, and wherein said first combustion-chamber surface means is generally concave when viewed from the interior of said second work combustion chamber.

32. An internal combustion engine according to claim 31 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

33. An internal combustion engine according to claim 31 and further comprising igniter means effectively in said second work combustion chamber, said igniter means being effective for igniting first any combustible mixture within said second work combustion chamber.

34. An internal combustion engine according to claim 31 wherein said second work combustion chamber comprises a generally concave surface when viewed from the interior of said second work combustion chamber, and further comprising an annular rim surface, said generally concave surface extending as to peripherally generally terminate in said annular rim surface, and wherein said rim surface defines one side of an annular passage for enabling said continuous communication between said first work combustion chamber and said second work combustion chamber.

35. An internal combustion engine according to claim 34 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

36. An internal combustion engine according to claim 31 and further comprising annular passage means generally peripherally about said second work combustion chamber for completing continuous communication as between said first work combustion chamber and said second work combustion chamber.

37. An internal combustion engine according to claim 36 and further comprising igniter means effectively in said second work combustion chamber, said igniter means being effective for igniting first any combustible mixture within said second work combustion chamber.

38. An internal combustion engine according to claim 36 wherein said annular passage means is peripherally continuous about said second work combustion chamber.

39. An internal combustion engine according to claim 38 and further comprising igniter means effectively in said second work combustion chamber, said igniter means being effective for igniting first any combustible mixture within said second work combustion chamber.

40. An internal combustion engine according to claim 31 and further comprising generally centrally disposed axially extending stationary core-like body means, wherein said first radially inner annular wall is carried by said stationary core-like body means, wherein said second work combustion chamber comprises first and second combustion-chamber surfaces, wherein said first combustion-chamber surface is stationary and is carried by a stationary axial end of said stationary core-like body means, and wherein said second combustion-chamber surface is carried by said engine housing as to be spaced from and generally juxtaposed to said first combustion-chamber surface.

41. An internal combustion engine according to claim 40 wherein said first and second combustion-chamber surfaces are each of a generally concave configuration with the concavity thereof being in opposed directions when viewed from the interior of said second work combustion chamber.

42. An internal combustion engine according to claim 40 wherein said first combustion-chamber surface comprises a concave surface of a generally spherical configuration when viewed from the interior of said second work combustion chamber.

43. An internal combustion engine according to claim 40 wherein said second combustion-chamber surface comprises a concave surface of a generally spherical configuration when viewed from the interior of said second work combustion chamber.

44. An internal combustion engine according to claim 40 wherein each of said first and second combustion-chamber surfaces comprises a concave surface of a generally spherical configuration when viewed from the interior of said second work combustion chamber.

45. An internal combustion engine, comprising an engine housing, an annular cylinder formed in said housing, said annular cylinder comprising a first radially inner annular wall and a second radially outer annular wall, a ring-like piston received in said annular cylinder for reciprocating movement therein, said ring-like piston comprising a ring-like working surface means, said first and second annular walls and said working surface means comprising combustion chamber means, motion transmitting means operatively connected to said ring-like piston for transmitting the reciprocating movement of said ring-like piston to associated power output means, and a plurality of ports, said plurality of ports comprising a first plurality of inlet ports for enabling the flow of a combustible mixture into said combustion chamber means, said plurality of ports comprising a second plurality of exhaust ports for enabling the exhausting of gases burned in said combustion chamber means, each of said plurality of inlet ports and said plurality of exhaust ports being opened to communication by said ring-like piston during said reciprocating movement thereof, said first plurality of inlet ports being formed in said first radially inner annular wall, said first plurality of inlet ports being so situated as to have a first select group of said plurality of inlet ports formed on one diametral side of said first radially inner annular wall and a second select group of said plurality of inlet ports formed on a second diametral side of said first radially inner annular wall generally opposite to said one diametral side, said second plurality of exhaust ports being formed in said second radially outer annular wall, said second plurality of exhaust ports being so situated as to have a first select group of said plurality of exhaust ports formed on one diametral side of said second radially outer annular wall and a second select group of said plurality of exhaust ports formed on a second diametral side of said second radially outer annular wall generally opposite to said one diametral side of said second radially outer annular wall, said first and second select groups of said inlet ports and said first and second select groups of said exhaust ports being so positioned as to have the flow from said first and second select groups of said inlet ports be generally normal to the flow from said first and second select groups of said exhaust ports.

46. An internal combustion engine according to claim 45 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

47. An internal combustion engine according to claim 45 and further comprising pre-compression chamber means for receiving a combustible mixture therein, and passage means interconnecting said inlet ports and said pre-compression chamber means.

48. An internal combustion engine according to claim 45 wherein said motion transmitting means comprises crankshaft means and connecting rod means, said crankshaft means comprising a large diameter live bearing portion journalled in said engine housing, said crankshaft means further comprising an eccentrically disposed portion, and wherein said eccentrically disposed portion is journalled in said large diameter live bearing portion whereby said eccentrically disposed portion is effective for drivingly rotating said large diameter live bearing portion.

49. An internal combustion engine according to claim 48 wherein said eccentrically disposed portion comprises first and second eccentric bearing portions, wherein said first eccentric bearing portion is disposed axially outwardly of said large diameter live bearing portion at said first axial end, wherein said second eccentric bearing portion is disposed axially outwardly of said large diameter live bearing portion at said second axial end, wherein said connecting rod means comprises first and second connecting rods, and wherein said first and second connecting rods are respectively operatively connected to said first and second eccentric bearing portions.

50. An internal combustion engine according to claim 49 and further comprising a second large diameter live bearing portion carried by said crankshaft means and journalled in said engine housing, said second large diameter live bearing portion being situated as to be axially spaced from said first mentioned large diameter live bearing portion as to generally contain said first connecting rod axially between said first mentioned large diameter live bearing portion and said second large diameter live bearing portion.

51. An internal combustion engine according to claim 45 and further comprising piston guide means, said guide means comprising first and second guide portions carried by said ring-like piston and third and fourth guide portions carried by said engine housing, said first and third guide portions being in operative engagement with each other during said reciprocating movement of said ring-like piston, and said second and fourth guide portions being in operative engagement with each other during said reciprocating movement of said ring-like piston.

52. An internal combustion engine according to claim 51 wherein said first and second guide portions comprise first and second surface extensions extending from said ring-like piston in a direction generally toward said crankshaft means, wherein said first surface extension is on one side of said crankshaft means and said second surface extension is on a side of said crankshaft means opposite to said one side when said first and second surface extensions and said crankshaft means are viewed in a cross-sectional plane passing generally transversely through said crankshaft means.

53. An internal combustion engine according to claim 52 wherein said third and fourth guide portions respectively comprise first and second slidable guide members carried by said engine housing.

54. An internal combustion engine according to claim 53 wherein each of said first and second slidable guide members is adjustably mounted with respect to said engine housing.

55. An internal combustion engine according to claim 45 wherein said combustion chamber means comprises a first ring-like combustion chamber portion defined generally and cooperatively by said inner and outer annular walls and said piston working surface means, said combustion chamber means further comprising a second portion situated generally axially of said first combustion chamber portion, said first and second combustion chamber portions being in communication with each other, said second combustion chamber portion being of unexpandable volume, said second combustion chamber portion comprising first and second combustion chamber surface means, wherein said first and second combustion chamber surface means are spaced from each other, and wherein said first combustion chamber surface means is generally concave.

56. An internal combustion engine according to claim 55 wherein said motion transmitting means comprises crankshaft means and connecting rod means, said crankshaft means comprising a large diameter live bearing portion journalled in said engine housing, said connecting rod means comprising at least first and second connecting rods, said first connecting rod being operatively connected to said crankshaft means at a first axial end of said large diameter live bearing portion, and said second connecting rod being operatively connected to said crankshaft means at a second axial end of said large diameter live bearing portion opposite to said first axial end.

57. An internal combustion engine according to claim 55 and further comprising igniter means effectively in said second combustion chamber portion, said igniter means being effective for igniting first any combustible mixture within said second combustion chamber portion.

58. An internal combustion engine according to claim 55 wherein said second combustion chamber portion comprises a generally concave surface, and further comprising an annular rim surface, said generally concave surface extending upwardly as to generally terminate in said annular rim surface, and wherein said rim surface defines one side of an annular passage for enabling said communication between said first combustion chamber portion and said second combustion chamber portion.

59. An internal combustion engine according to claim 55 and further comprising annular passage means generally peripherally about said second combustion chamber portion for completing communication as between said first combustion chamber portion and said second combustion chamber portion.

60. An internal combustion engine according to claim 59 and further comprising igniter means effectively in said second combustion chamber portion, said igniter means being effective for igniting first any combustible mixture within said second combustion chamber portion.

61. An internal combustion engine according to claim 59 wherein said annular passage means is peripherally continuous about said second combustion chamber portion.

62. An internal combustion engine according to claim 61 and further comprising igniter means effectively in said second combustion chamber portion, said igniter means being effective for igniting first any combustible mixture within said second combustion chamber portion.

63. An internal combustion engine according to claim 55 and further comprising generally centrally disposed axially extending core-like body means, wherein said first radially inner annular wall is carried by said core-like body means, wherein said first combustion chamber surface is carried by the axial end of said core-like body means, and wherein said second combustion chamber surface is carried by said engine housing as to be spaced from and generally juxtaposed to said first combustion chamber surface.

64. An internal combustion engine according to claim 63 wherein said first and second combustion chamber surfaces are each of a generally concave configuration with the concavity thereof being in opposed directions.

65. An internal combustion engine according to claim 63 wherein said first combustion chamber surface comprises a generally spherical surface.

66. An internal combustion engine according to claim 63 wherein said second combustion chamber surface comprises a generally spherical surface.

67. An internal combustion engine according to claim 63 wherein each of said first and second combustion chamber surfaces comprise a generally spherical surface.

68. An internal combustion engine, comprising an engine housing, an annular cylinder formed in said housing, said annular cylinder comprising a first radially inner annular wall and a second radially outer annular wall, a ring-like piston received in said annular cylinder for reciprocating movement therein, motion transmitting means operatively connected to said ring-like piston for transmitting the reciprocating movement of said ring-like piston to associated power output means, combustion chamber means, said combustion chamber means comprising a first ring-like combustion chamber portion defined generally and cooperatively by said inner and outer annular walls and said piston, said combustion chamber means further comprising a second portion situated generally axially of said first ring-like combustion chamber portion, said first and second combustion chamber portions being in communication with each other and effective for receiving a combustible mixture therein, said second combustion chamber portion being of unexpandable volume, and means for initiating ignition of said combustible mixture first within said second combustion chamber portion and only thereafter causing ignition of said combustible mixture within said first combustion chamber portion, wherein said motion transmitting means comprises crankshaft means and connecting rod means, said crankshaft means comprising a large diameter live bearing portion journalled in said engine housing, said crankshaft means further comprising an eccentrically disposed portion, and wherein said eccentrically disposed portion is journalled in said large diameter live bearing portion whereby said eccentrically disposed portion is effective for drivingly rotating said large diameter live bearing portion.

69. An internal combustion engine according to claim 68 wherein said eccentrically disposed portion comprises first and second eccentric bearing portions, wheren said first eccentric bearing portion is disposed axially outwardly of said large diameter live bearing portion at said first axial end, wherein said second eccentric bearing portion is disposed axially outwardly of said large diameter live bearing portion at said second axial end, wherein said connecting rod means comprises first and second connecting rods, and wherein said first and second connecting rods are respectively operatively connected to said first and second eccentric bearing portions.

70. An internal combustion engine according to claim 69 and further comprising a second large diameter live bearing portion carried by said crankshaft means and journalled in said engine housing, said second large diameter live bearing portion being situated as to be axially spaced from said first mentioned large diameter live bearing portion as to generally contain said first connecting rod axially between said first mentioned large diameter live bearing portion and said second large diameter live bearing portion.

71. An internal combustion engine, comprising an engine housing, an annular cylinder formed in said housing, said annular cylinder comprising a first radially inner annular wall and a second radially outer annular wall, a ring-like piston received in said annular cylinder for reciprocating movement therein, said ring-like piston comprising a ring-like working surface means, said first and second annular walls and said working surface means comprising combustion chamber means, motion transmitting means operatively connected to said ring-like piston for transmitting the reciprocating movement of said ring-like piston to associated power output means, exhaust valve means effective to at times enable the flow of gases burned in said combustion chamber means to be exhausted therefrom, and a plurality of intake ports for enabling the flow of a combustible mixture into said combustion chamber means when said intake ports are uncovered by said ring-like piston during said reciprocating movement thereof, said plurality of intake ports comprising a first plurality of ports formed in said first radially inner annular wall and a second plurality of ports formed in said second radially outer annular wall, wherein said motion transmitting means comprises crankshaft means and connecting rod means, said crankshaft means comprising a large diameter live bearing portion journalled in said engine housing, said crankshaft means further comprising an eccentrically disposed portion, and wherein said eccentrically disposed portion is journalled in said large diameter live bearing portion whereby said eccentrically disposed portion is effective for drivingly rotating said large diameter live bearing portion.

72. An internal combustion engine according to claim 71 wherein said eccentrically disposed portion comprises first and second eccentric bearing portions, wherein said first eccentric bearing portion is disposed axially outwardly of said large diameter live bearing portion at said first axial end, wherein said second eccentric bearing portion is disposed axially outwardly of said large diameter live bearing portion at said second axial end, wherein said connecting rod means comprises first and second connecting rods, and wherein said first and second connecting rods are respectively operatively connected to said first and second eccentric bearing portions.

73. An internal combustion engine according to claim 72 and further comprising a second large diameter live bearing portion carried by said crankshaft means and journalled in said engine housing, said second large diameter live bearing portion being situated as to be axially spaced from said first mentioned large diameter live bearing portion as to generally contain said first connecting rod axially between said first mentioned large diameter live bearing portion and said second large diameter live bearing portion.

74. An internal combustion engine, comprising an engine housing, an annular cylinder formed in said housing, said annular cylinder comprising a first radially inner annular wall and a second radially outer annular wall, a ring-like piston received in said annular cylinder for reciprocating movement therein, motion transmitting means operatively connected to said ring-like piston for transmitting the reciprocating movement of said ring-like piston to associated power output means, combustion chamber means, said combustion chamber means comprising a first ring-like combustion chamber portion defined generally and cooperatively by said inner and outer annular walls and said piston, said combustion chamber means further comprising a second portion situated generally axially of said first ring-like combustion chamber portion, said first and second combustion chamber portions being in communication with each other, said second combustion chamber portion being of unexpandable volume, exhaust valve means effective to at times enable the flow of gases burned in said combustion chamber means to be exhausted therefrom, a plurality of intake ports for enabling the flow of a combustible mixture into said combustion chamber means when said intake ports are uncovered by said ring-like piston during said reciprocating movement thereof, said plurality of intake ports comprising a first plurality of ports formed in said first radially inner annular wall and a second plurality of ports formed in said second radially outer annular wall, pre-compression chamber means for receiving a combustible mixture therein, and passage means interconnecting said intake ports and said pre-compression chamber means, said passage means comprising first conduit means and second conduit means, said first conduit means serving to flowingly interconnect said first plurality of ports to said pre-compression chamber, and said second conduit means serving to flowingly interconnect said second plurality of ports to said pre-compression chamber.

75. An internal combustion engine, comprising an engine housing, an annular cylinder formed in said housing, said annular cylinder comprising a first radially inner wall and a second radially outer annular wall, a ring-like piston received in said annular cylinder for reciprocating movement therein, said ring-like piston comprising a ring-like working surface means, said first and second annular walls and said working surface means comprising combustion chamber means, motion transmitting means operatively connected to said ring-like piston for transmitting the reciprocating movement of said ring-like piston to associated power output means, exhaust valve means effective to at times enable the flow of gases burned in said combustion chamber means to be exhausted therefrom, a plurality of intake ports for enabling the flow of a combustible mixture into said combustion chamber means when said intake ports are uncovered by said ring-like piston during said reciprocating movement thereof, said plurality of intake ports comprising a first plurality of ports formed in said first radially inner annular wall and a second plurality of ports formed in said second radially outer annular wall, pre-compression chamber means for receiving a combustible mixture therein, and passage means interconnecting said intake ports and said pre-compression chamber means, said passage means comprising first conduit means and second conduit means, said first conduit means serving to flowingly interconnect said first plurality of ports to said pre-compression chamber, and said second conduit means serving to flowingly interconnect said second plurality of ports to said pre-compression chamber.

* * * * *